US006474885B2

(12) United States Patent
Kuzniarek et al.

(10) Patent No.: US 6,474,885 B2
(45) Date of Patent: Nov. 5, 2002

(54) ROLLER SYSTEM TO HELP REMOVE CHAD AND TRIMMED MEDIA IN A THERMAL PRINTER

(75) Inventors: Joseph S. Kuzniarek, Hilton, NY (US); Mark A. Bayer, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 27 days.

(21) Appl. No.: 09/826,643

(22) Filed: Apr. 5, 2001

(65) Prior Publication Data

US 2002/0146270 A1 Oct. 10, 2002

(51) Int. Cl.[7] ..... B41J 13/02; B41J 13/10

(52) U.S. Cl. ..... 400/624; 400/621; 83/156; 83/167

(58) Field of Search ..... 400/621, 624; 83/156, 167

(56) References Cited

U.S. PATENT DOCUMENTS 3,728,920 A * 4/1973 Gardner et al. ..... 83/106
4,013,357 A * 3/1977 Nakajima et al. ..... 355/29
4,312,597 A * 1/1982 Shimizu et al. ..... 101/224
4,445,409 A * 5/1984 Mohr et al. ..... 83/157
4,491,046 A * 1/1985 Hosogaya ..... 83/543
5,482,389 A * 1/1996 Bickoff et al. ..... 101/93.07
5,823,694 A * 10/1998 Ikegami ..... 400/593
5,913,624 A * 6/1999 Ikegami ..... 400/615.2

* cited by examiner

*Primary Examiner*—Andrew H. Hirshfeld
*Assistant Examiner*—Jill Culler
(74) *Attorney, Agent, or Firm*—Norman Rushefsky

(57) ABSTRACT

For a printer system (38) having a thermal printhead or an inkjet printhead for printing images on receiver media, such as sheets of paper (14), a pick roller (18) for drawing at least on sheet of paper (14), and a cutter assembly (26) for trimming the printed paper **(14*a*) to size, a roller system (5), to help remove chad (16) and trimmed media in thermal printer (38), which is known to cause paper jams and interfere with printing, is disclosed. The roller system (5) comprises a paper tray (7) configured to hold a supply of paper (14), or other flexible media. The roller system (5) further comprises a roller (12) and a tray cover (10). Roller (12), which is located in contact with the supply of paper (14), is configured to operate in connection with the actions of the pick roller (18). Tray cover (10) is positioned over the paper tray (7) and includes an aperture adapted to receive roller (12). Roller (12) rotates intermittently during the operation of the pick roller (18) and moves chad (16) toward a holding area (22)**.

25 Claims, 3 Drawing Sheets

ROLLER SYSTEM TO HELP REMOVE CHAD AND TRIMMED MEDIA IN A THERMAL PRINTER

FIELD OF THE INVENTION

This invention relates in general to sublimation dye thermal and inkjet printing systems and, more specifically, to thermal printers for photographic image printing. More particularly, the invention relates to a method and system for removing paper trimmings that are created internally in thermal printer systems and that would otherwise interfere with printing.

BACKGROUND OF THE INVENTION

Without limiting the scope of the invention, its background is described in connection with thermal printers, such as the Kodak Photo Printer 4720 (Sidewinder 2 Thermal Printer), as an example.

Thermal and inkjet printing systems are commonly used for the production of text and graphic images for home, office and commercial applications. Such printing systems include receiver media for printing, such as paper, which can be supplied either from a stack or several stacks of pre-cut receiver media, or can be cut from a receiver media supply roll. After the printing cycle, an internal cutter assembly is utilized to trim printed receiver media to size and/or to cut non-printed areas from the printed receiver media. These paper trimmings (or "chad") are intended to fall from the cutter assembly and down on a paper tray having a tray cover. The tray and tray cover are commonly found in the device directly beneath the cutter assembly. In most cases, the tray cover is designed to cause the trimmings to slide into a temporary holding area. The trimmings are then removed from the temporary holding area by an operator at the same time the supply of receiver media is replenished.

Frequently, however, static charges build up in the area due to the act of cutting the receiver media and causing it to travel through a designated area. If not static, other factors and/or conditions, such as chad size, chad position, or humidity, for example, may exist. Whether individually or in combination, these factors and conditions have been found to cause paper trimmings to stick on the ray cover, and prohibiting their removal away from the cutter assembly. In some instances, the chad will pile up to the point of causing interference with the paper path or creating paperjams.

Accordingly, a need exists for a printer system with integral means for reliably storing trimmings produced during the printing and cutting of receiver media. A need also exists for a system which would prevent paper trimmings from interfering with the function of the printer. As such, a means of controlling the build-up of paper trimmings resulting from the cutting of printed receiver media would provide numerous advantages.

SUMMARY OF THE INVENTION

The present invention provides a system and method for moving paper trimmings, or chad, that are created internally in thermal printers that otherwise could interfere with printing. With the present invention, chad build-up is eliminated and the possibility for paper jams is decreased.

Accordingly, disclosed in one embodiment is a printer system comprising a roller system for directing trimmings resulting from the cutting of printed receiver media into a holding area. In a preferred embodiment of the present invention, the roller system includes a roller configured to translate the paper trimmings away from the cutter assembly. The roller can be configured to rotate intermittently, thus operating in connection with the actions of a pick roller.

The roller system also comprises a tray configured to hold a supply of receiver media for printing. The supply of receiver media can include a plurality of receiver media sheets, or a receiver media supply roll, for example. Positioned over the tray is a tray cover having at least one aperture for receiving a roller or drive belt. In one embodiment, the tray cover is in a sloped position, so that it sits 15 degrees from its X-axis position. The tray cover further includes a temporary storage cavity integral to the tray cover. As such, the temporary storage cavity defines a holding area for trimmings resulting from the cutting of printed receiver media. Thus, if the tray is adapted to hold 100 sheets of paper, then the holding area of the temporary storage cavity is adapted to hold trimmings from 100 sheets of paper. As such, the volume of the holding area and the number of sheets of paper are proportional.

The printer system also comprises a receiver media feeder for drawing receiver media from the supply of receiver media unto a receiver media path. In one embodiment, the receiver media feeder is a pick roller adapted to come in contact with the supply of receiver media in the tray. The pick roller is configured to rotate and direct receiver media along a receiver media path.

The printer system further comprises a printhead for printing images on the receiver media from the supply of receiver media and a cutter assembly for trimming the printed receiver media to size. In one embodiment, the printer system includes means for retaining at least one edge of the receiver media during the printing process. Typically, the area retained will remain blank, or free of printed images. As such, those non-printed areas on the printed receiver media will require cutting. The cutter assembly further includes first and second rollers, which are configured to direct printed receiver media out via the exit pathway after cutting. In another embodiment, a third roller is operably engaged with the second roller and positioned above the temporary storage cavity in order to eliminate the build-up of receiver media trimmings at the edge of the holding area.

According to another embodiment, disclosed is a method of controlling the build-up of trimmings, or chad, resulting from the cutting of printed receiver media for a printer system including an internal supply of receiver media and means for printing images on the receiver media. Initially, receiver media is drawn from a tray and directed to a receiver media path. Concurrently, a roller is caused to translate trimmings from previous cutter activity into a temporary holding area. While the trimmings are being directed to their designated area, the receiver media drawn from the tray is positioned for printing. That is, the receiver media is retained from at least one edge in position during the printing process. Once printing has terminated, non-printed areas on the receiver media are identified, such as the area where the receiver media was retained. Those areas are then trimmed so as to cut the printed receiver media to size.

The method further comprises the step of causing the cut printed receiver media to exit via an exit pathway. Concurrently, a roller is caused to tumble stacks of trimmings, which may have formed on the edge of the holding area, into the holding area. The motion of the roller is accomplished by a friction interface with rollers within the cutter assembly, or through belt drives or direct gearing.

In this way, the present invention provides a printer system with integral means for reliably removing chad produced during the printing and cutting of receiver media.

A technical advantage of the invention is a printer system which is designed to prevent paper trimmings from interfering with the function of the printer. Larger printing cycles can be obtained without maintenance and with less interruption. Therefore, the user benefits from reduced maintenance costs.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description, unless otherwise indicated.

DETAILED DESCRIPTION OF THE INVENTION

While the making and using of various embodiments of the present invention are discussed in detail below, it should be appreciated that the present invention provides many applicable, inventive concepts which can be embodied in a wide variety of specific contexts. These specific embodiments discussed herein are merely illustrative of specific ways to make and use the invention, and do not delimit the scope or application of the invention.

Figure 1:
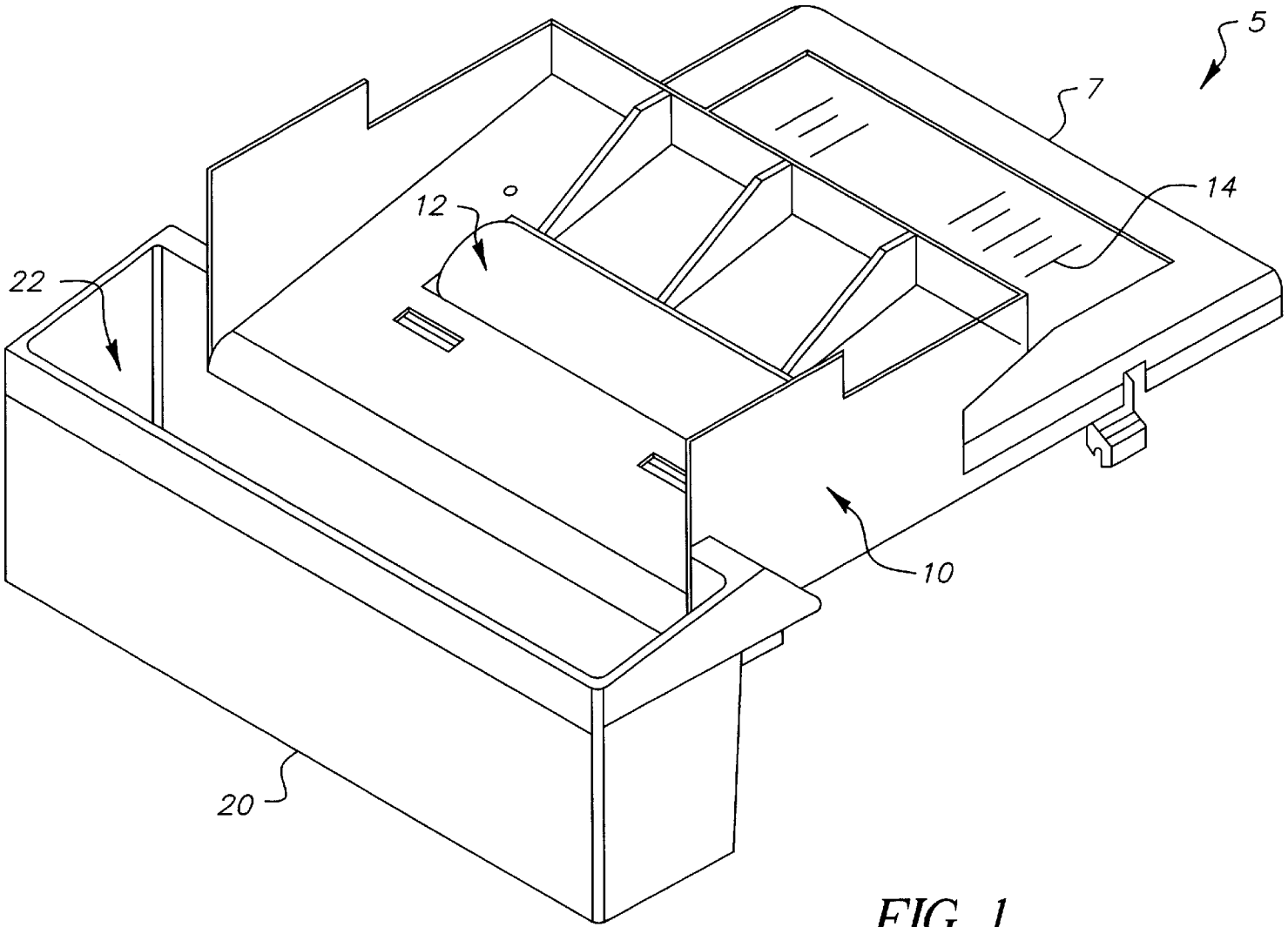
FIG. 1 is a top view of a roller system, in accordance with a preferred embodiment of the present invention.
Figure 2:
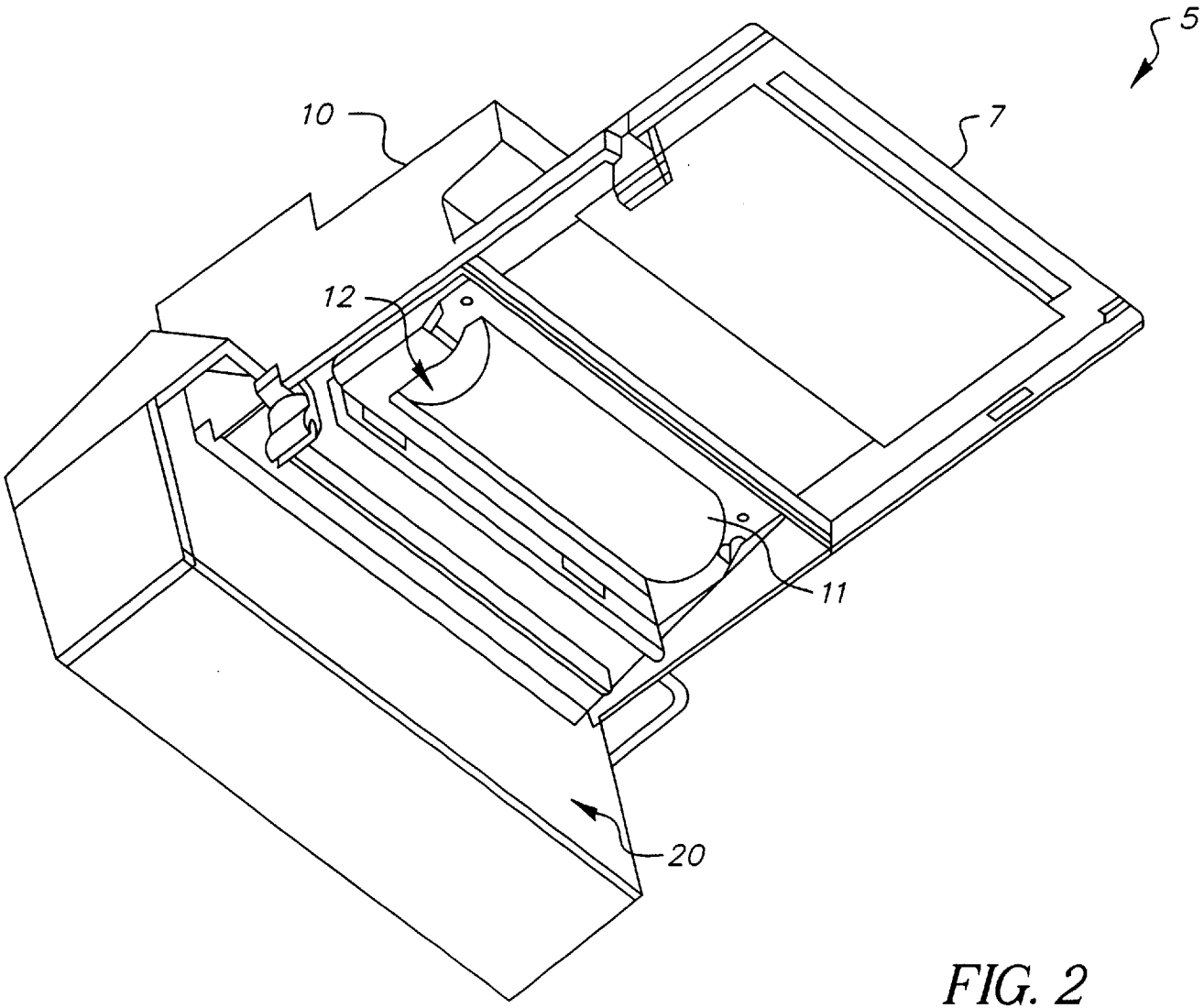
FIG. 2 is a bottom view of the roller system of FIG. 1.
Figure 3:
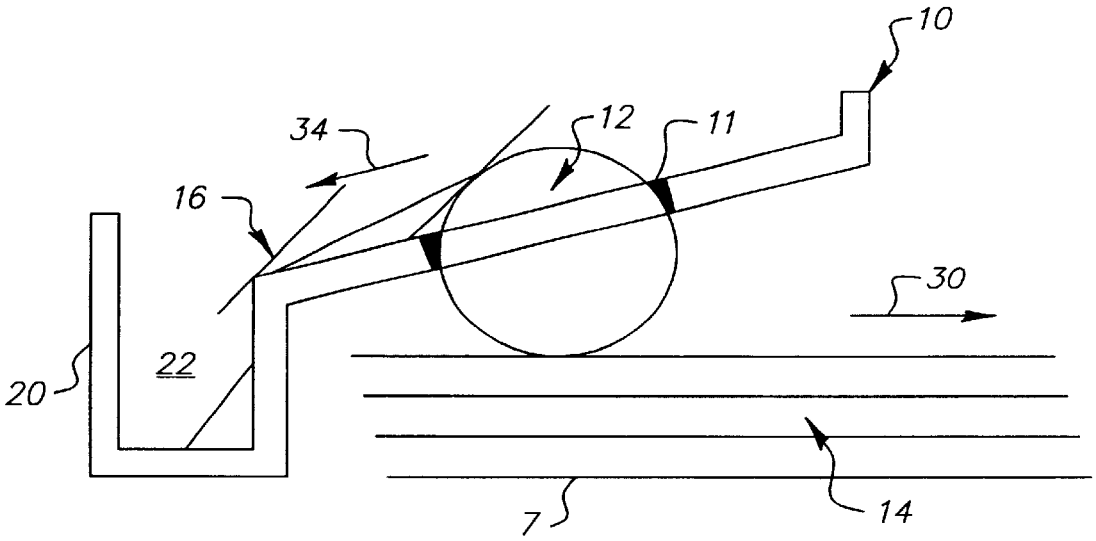
FIG. 3 illustrates the roller system of FIGS. 1 and 2 in operation, in accordance with the preferred embodiment of the present invention.

Referring to FIGS. 1–3, therein is shown a roller system for directing trimmings resulting from the cutting of printed receiver media into a holding area, denoted generally as 5, in accordance with a preferred embodiment of the present invention. Specifically, FIG. 1 is a top view of roller system 5, while FIG. 2 is a bottom view of roller system 5. FIG. 3 illustrates the roller system 5 of FIGS. 1 and 2 in operation.

Roller system 5 comprises a tray 7 configured to hold a supply of receiver media 14 for printing. The supply of receiver media 14 can include a plurality of receiver media sheets, or a receiver media supply roll, for example. The term "receiver media" as used in this application includes the various flexible materials on which images can be recorded, such as paper, transparencies and photographic materials, for example. All such flexible material will be referred to hereinafter as paper 14. In particular, tray 7 is adapted to be used in conjunction with printer systems, such as the Kodak Photo Printer 4720 (Sidewinder 2 thermal printer). The Kodak Photo Printer 4720 (Sidewinder 2 thermal printer) is only one example of a thermal printer in which the present invention can be implemented. In the more general sense, however, the present invention can be utilized in thermal printer systems which are capable of photographic image printing.

As shown in FIG. 3, roller system 5 further comprises at least one roller 12 configured to translate trimmings 16 away from the receiver media path and other areas that may be effected by a buildup of trimmings 16. The terms "trimmings" and "chad" will be used interchangeably hereinafter and denoted as 16. The roller 12 is positioned within the tray cover 10 which includes an aperture 11 adapted to receive the roller 12. That is, the roller 12 extends above and below the tray cover 10, as illustrated in FIGS. 1 and 2. As such, below the tray cover 10, roller 12 is located in contact with the stack of paper 14 in the tray 7 and will ultimately be in contact with chad 16 in the tray cover 10, as shown in FIG. 3.

Figure 4:
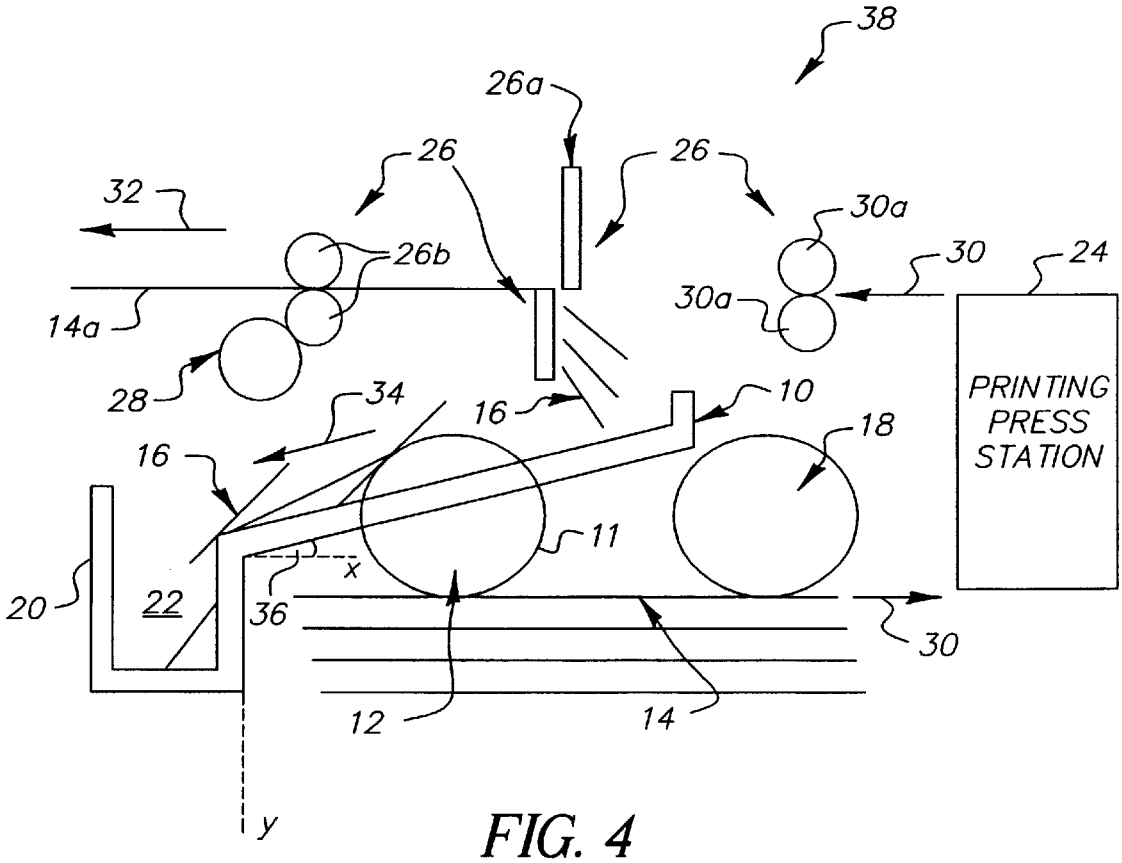
FIG. 4 illustrates a thermal printer system embodying the roller system of the present invention with the addition of a third roller, in accordance with a preferred embodiment of the present invention.

With reference to FIG. 4, roller 12 is further configured to rotate intermittently and in connection with the actions of a pick roller 18 of a printer system 38, as shown in FIG. 4. In this way, rotation of the roller 12 is accomplished every time a piece of paper 14 is picked from the tray 7 and moved into the paper path 30 for printing. Thus, the position and motion of the roller 12 acts to straighten and push trimmings 16 that have fallen into the tray cover 10, as well as prevent trimmings 16 from piling up in any one area.

In present designs, these trimmings 16 are intended to fall from the cutter assembly 26 of a printer system 38 and down on the tray cover 10 of tray 7 via gravity. Tray 7 and tray cover 10 are commonly found beneath the cutter assembly 26. Frequently, however, static charges build up due to the acts of cutting the paper 14 and causing it to travel through a designated area. If not static, other factors and/or conditions, such as chad size, chad position, or humidity, for example, may exist which contribute to the build-up of chad and which may obstruct the paper path of the printer and/or create paperjams. Whether individually or in combination, these factors and conditions may cause the trimmings 16 to stick on the tray cover 10 making it difficult to remove from the cutter assembly 26 and adjacent areas. As such, trimmings 16 are likely to create a pile so high to the point that it interferes with the paper path 30. As a result, feeding jams and/or jams in the cutter assembly 26 are likely to occur.

In a preferred embodiment of the present invention, roller system 5 includes a temporary storage cavity 20 which is integral to the tray cover 10. The temporal storage cavity 20 further defines a holding area 22. The tray cover 10 is angled in a sloped position in order to cause trimmings 16 to slide into the holding area 22. In this position, roller 12 is able to direct trimmings 16 to the holding area 22. In alternative embodiments, the roller system 5 can include a variation of multiple rollers, or a belt and pulley arrangement to overcome the factors and/or conditions discussed above. The trimmings 16 are then removed from the holding area 22 by an operator, for example, at the same time the tray 7 is being refilled.

With further reference to FIG. 4, the thermal printer system 38 includes the roller system 5 with the addition of a third roller 28, in accordance with a preferred embodiment of the present invention. The printer system 38 further includes a receiver media feeder 18, a printing process station 24, and a cutter assembly 26. Initially, an operator fills the tray 7 of the roller system 5 with a supply of receiver media, such as paper 14, for printing. In one embodiment, tray 7 is configured to accept no more than one hundred (100) sheets of paper. In another embodiment, the supply of receiver media 14 can include a receiver media roll, such as photographic material which is supplied in long length. Once the tray 7 is filled within its capacity, tray 7 is operably engaged to a component (not shown) of the printer system 38 housing the receiver media feeder 18.

The receiver media feeder 18 comprises a pick roller adapted to come in contact with the supply of paper 14 in tray 7. In operation, paper 14 is picked by the pick roller 18, one sheet at a time, and moved along paper path 30 to a station within the printer system 38 where printing occurs, such as printing process station 24. A sheet of paper is then positioned and retained by at least one edge (not shown) utilizing a clamp, for example. Printing is then commenced at printing process station 24 comprising a printhead and thermal dye media or an inkjet printhead (not shown) for printing images on the paper 14 from the supply in tray 7.

After printing, the printed receiver media, or printed paper 14*a* is transported to the cutter assembly 26 for trimming the printed paper 14*a* to size. From the printing process station 24, the printed paper 14*a* travels along paper path 30, through rollers 30*a*, and to the cutter 26*a* within the cutter assembly 26. There, the non-printed area on the printed paper 14*a*, such as the edge retained for printing, is cut. In one embodiment, the cutter 26*a* within cutter assembly 26 is configured to trim leading and trailing edges of the printed paper 14*a*. Due to gravity, these trimmings 16 fall from the cutter assembly onto the tray cover 10 and into a holding area 22 defined by a temporary storage cavity 20. However, gravity alone does not cause all trimmings 16 to fall within holding area 22. As a result, static can develop within the area between the cutter assembly 26 and the tray cover 10, or other factors and/or conditions may exist, such as humidity, chad size and chad position, which can cause feeding jams, jams in the cutter assembly 26, or both.

The preferred embodiment comprises a roller 12 located within an aperture 11 of tray cover 10 that is attached to tray 7 containing a supply of paper 14. Tray cover 10 is in a sloped position, such as at a 15 degree angle 36 from its x-axis, in order to help direct trimmings 16 to its predetermined location. In operation, the roller 12, which operates in connection with the actions of pick roller 18, is intermittently rotated as paper 14 is picked by pick roller 18. That is, rotation of the roller 12 is accomplished every time a sheet of paper 14 is drawn from tray 7 and moved into paper path 30. This rotation of the roller 12 translates chad 16 resulting from the cutting of printed paper 14a away from the cutter 26*a* by breaking static forces between the piece of chad 16 and the material of which the tray cover 10 comprises, such as plastic. As such, roller 12 is configured to urge chad 16 along chad pathway 34 and toward holding area 22 integral to tray cover 10. The position and motion of the roller 12 acts to straighten and push trimmings 16 that have fallen into the tray cover 10 at an angle and prevents the trimmings 16 from stacking in any one area. Thus, trimmings 16 produced during printing and cutting is reliably reversed and stored for a temporary period, or until the supply of paper 14 in tray 7 is re-filled by an operator who concurrently empties out the temporary storage cavity 20.

Once the printed paper 14*a* has been cut, the cut printed paper 14*a* is transported through rollers 26*b* and out the exit pathway 32 to a post-print treatment station (not shown), for example. Concurrently, another sheet of paper is picked by pick roller 18, and the printed and cutting processes are repeated. As the amount of trimmings 16 increases and conditions such as humidity exist, the possibility of chad build-up at the edge of the holding area 22*a* is more probable than not. The accumulation of trimmings 16 outside of the holding area 22 can block the paper path 30, and/or cause Adam in such a way as to interfere with the function of the printer system 38.

In a preferred embodiment of the present invention, the cutter assembly 26 comprises first and second rollers 26*b* configured to direct the printed paper 14*a* through the exit pathway 32 after cutting. In addition, the printer system 38 further comprises a third roller 28 operably engaged with the second roller 26*b* and positioned above the temporary storage cavity 20. In operation, the motion of roller 28 is accomplished by a friction interface with rollers 26*b* within the cutter assembly 26. That is, while the printed paper 14*a* is passing through the rollers 26*b* and out the exit pathway 32, the rotation of the rollers 26*b* drives roller 28 to rotate in order to tumble over build-up of chad 16 in that area and cause this chad 16 to fall within the holding area 22. As a result, build-up of chad 16 is eliminated and interference with printing is prevented.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the impended claims encompass any such modifications or embodiments.

PARTS LIST

5 . . . roller system
7 . . . paper tray, receiver media tray, or tray
10 . . . tray cover
11 . . . aperture
12 . . . roller(s) or belt drive
14 . . . receiver media or paper
14*a* . . . printed receiver media or printed paper
16 . . . chad or trimmings
18 . . . receiver media feeder or pick roller
20 . . . temporary storage cavity
22 . . . holding area
24 . . . printing process station
26 . . . cutter assembly
26*a* . . . cutter
26*b* . . . rollers
28 . . . roller, third roller or belt drive
30 . . . paper path
30*a* . . . a rollers
32 . . . exit pathway
34 . . . chad pathway
36 . . . angle
38 . . . thermal printer system or printer system

What is claimed is:

1. A printer system comprising:

a roller system for directing trimmings resulting from the cutting of printed receiver media into a holding area, said roller system having a tray configured to hold a supply of receiver media for printing and a tray cover for covering said supply of receiver media, said tray cover including said holding area;

a receiver media feeder for drawing receiver media from said supply of receiver media to a receiver media path;

a printhead, either thermal or inkjet, for planting images on said receiver media from said supply of receiver media; and a cutter assembly for trimming said printed receiver media to size, to create said trimmings.

2. The printer system according to claim 1 wherein said supply of receiver media comprises a plurality of receiver media sheets.

3. The printer system according to claim 1 wherein said supply of receiver media comprises a receiver media supply roll.

4. The printer system according to claim 1 wherein said receiver media feeder is a pick roller adapted to come in contact with said supply of receiver media in said tray, said pick roller configured to direct said receiver media along said receiver media path by rotating.

5. The printer system according to claim 1 wherein said roller system further comprises at least one roller configured to translate trimmings away from said cutter assembly by rotating.

6. The printer system according to claim 5 wherein said roller is configured to rotate intermittently, said roller operating in connection with the actions of said receiver media feeder.

7. The printer system according to claim 5 wherein said tray cover is positioned over said tray, said tray cover having at least one aperture for receiving said roller.

8. The printer system according to claim 7 wherein said tray cover further includes a temporary storage cavity integral to said tray cover, wherein said temporary storage cavity defines said holding area.

9. The printer system according to claim 7 wherein said tray cover is in a sloped position.

10. The printer system according to claim 1 further comprising means for causing the trimmed printed receiver media to exit out an exit pathway.

11. The printer system according to claim 10 wherein said means for causing the trimmed printed receiver media to exit out an exit pathway further comprises first and second rollers configured to direct printed media through said exit pathway after cutting.

12. The printer system according to claim 11 further comprising a third roller operably engaged with said second roller and positioned above said holding area in order to eliminate build-up of receiver media trimmings.

13. In a printer having an inkjet printhead for printing images on receiver media or a thermal printhead for printing sublimation dye transfer images on receiver media, such as sheets of paper, a pick roller for drawing at least one sheet of paper, and a cutter assembly for trimming said printed sheet of paper to size, a roller system to help remove chad and/or trimmed media comprising:

a paper tray configured to hold a supply of paper for printing;

a chad and/or trimmed media removal roller configured to operate in connection with the actions of said pick roller, said chad and/or trimmed media removal roller located in contact with the supply of paper in said paper tray; and a tray cover positioned over said paper tray, said tray cover having at least one aperture for receiving said chad and/or trimmed media removal roller, said chad and/or trimmed media removal roller configured to direct said chad and/or trimmed media away from said cutter assembly.

14. The roller system according to claim 13 wherein said pick roller is further configured to direct said sheet of paper along a paper path by rotating.

15. The roller system according to claim 13 wherein said paper tray is configured to hold a stack of up to one hundred (100) sheets of paper.

16. The roller system according to claim 13 further comprising a temporary storage cavity integral to said tray cover, wherein said temporary storage cavity defines a holding area for said chad and/or trimmed media.

17. The roller system according to claim 13 wherein said chad and/or trimmed media removal roller is further configured to rotate intermittently.

18. The roller system according to claim 16 wherein said chad and/or trimmed media removal roller is further configured to direct trimmings and/or chad resulting from the cutting of printed paper away from said cutter assembly and into said holding area by rotating.

19. The roller system according to claim 13 wherein said tray cover is positioned at a 15 degree angle from its X-axis.

20. The roller system according to claim 13 wherein said number of sheets of paper and the volume of said holding area is proportional.

21. For a printer system including an internal supply of receiver media and means for printing images on said receiver media, a method of controlling the build-up of trimmings resulting from the cutting of printed receiver media comprising the steps of:

cutting said printed receiver media to size;

causing a roller to translate said trimmings into a holding area that forms a part of a cover of a holder for the supply of receiver media; and causing the cut printed receiver media to exit via an exit pathway.

22. The method according to claim 21 wherein said step of causing a roller to translate said trimmings into a holding area further includes the step of drawing receiver media from a tray and to a receiver media path.

23. The method according to claim 22 wherein said drawing step is followed by a step of retaining said receiver media for printing.

24. The method according to claim 21 wherein said cutting step is preceded by a step of identifying non-printed areas on said receiver media.

25. The method according to claim 21 wherein said step of causing the cut printed receiver media to exit via an exit pathway further includes a step of causing an additional roller to tumble said trimmings into the holding area.

* * * * *